US005979329A

United States Patent [19]

Collar

[11] Patent Number: 5,979,329

[45] Date of Patent: Nov. 9, 1999

[54] FIREWORKS LAUNCHING TUBE

[75] Inventor: Michael Collar, Clinton, Mo.

[73] Assignee: WINCO Fireworks, Inc., Clinton, Mo.

[21] Appl. No.: 09/032,864

[22] Filed: Mar. 2, 1998

[51] Int. Cl.[6] ..... F42B 4/04

[52] U.S. Cl. ..... 102/361; 102/342; 102/343; 102/349; 102/351

[58] Field of Search ..... 102/361, 343, 102/345, 349, 351, 360, 331, 342

[56] References Cited

U.S. PATENT DOCUMENTS

| | | | |
|---|---|---|---|
| 1,922,081 | 8/1933 | Driggs, Jr. | 102/351 |
| 4,724,768 | 2/1988 | Robinson et al. | 102/360 X |
| 4,917,015 | 4/1990 | Lowery | 102/361 X |
| 5,149,912 | 9/1992 | Waidner et al. | 102/351 |
| 5,339,741 | 8/1994 | Crayden et al. | 102/361 X |
| 5,429,053 | 7/1995 | Walker | 102/361 X |
| 5,567,907 | 10/1996 | Westfall | 102/361 X |
| 5,739,459 | 4/1998 | LaMura et al. | 102/360 X |

OTHER PUBLICATIONS

Zenith Specialties 1998 Catalog.

*Primary Examiner*—Peter A. Nelson
*Attorney, Agent, or Firm*—Litman, Kraai & Brown L.L.C.; John McMahon

[57] ABSTRACT

A launcher for launching aerial firework shells into the air includes a base and an upright tubular member. The tubular member is constructed of a plastic that resists damage from the explosive force of the fireworks and allows substantial reuse of the launcher for multiple shells. The tubular member is seated in an indentation in the base that snugly receives the sides of the tubular member. The tubular member is preferably secured to the base by stainless steel staples to allow for use of the launcher in a damp environment and over multiple years.

8 Claims, 2 Drawing Sheets

FIREWORKS LAUNCHING TUBE

BACKGROUND OF THE INVENTION

The present invention is directed to a launcher for repetitively launching aerial fireworks shells.

Fireworks of the type that are often referred to as shells are launched from tubular structures. The shells include a long fuse and are each sequentially dropped into the tube and fired. Each shell includes an explosive charge which propels the remainder of the shell out of the tube and into the air where it subsequently explodes and produces a more and/or colorful aerial display. Such shells originally came with individual tubes which are expensive and bulky to ship. Later, as popularity in the shells begin to increase multiple shells were packaged along with a single tube. These original tubes were normally manufactured from paper or a similar substance and were not designed for more than a minimal number of repetitive shots. Consequently, most of the fireworks displays of this type are packaged with a single tube and perhaps six shells.

Because of the popularity of the shells, more and more manufacturers are interested in packaging additional shells in a single package to be sold to the consumer. Because the paper launchers have a limited capacity for the number of shells that can be shot from them, large number of shells require multiple conventional tubes. This causes several potential problems. The first of these problems is that the tubes take up substantially greater space on the shelves and multiple tubes simply are more bulky and costly to ship. The second problem is that a consumer may ignore warnings to only shoot a limited number of shells from a particular tube and try to shoot more than the safe maximum rather than using a new tube. This could result in injury to persons or property, if the tube fail.

Therefore, it has become desirable to provide a shell launcher which can launch numerous shells from the same tube without serious threat of injury or harm. If it were possible, it is desirable for the launcher to even be reusable in subsequent years so a consumer would not have to expend the money for the manufacturing and shipping of a launcher for each set of shells purchased.

SUMMARY OF THE INVENTION

The shell launcher is provided for launching fireworks of the aerial shell type. The launcher includes an upright tubular member and a base.

The base includes an indentation which is circular and which snugly receives an outer surface of the tube. The tube is secured in the indentation of the base by a fastener such as a stainless steel staple, glue or the like.

The tube is constructed of a plastic material of sufficient rigidity to withstand the explosive forces encountered during the launch of numerous shells. Preferably the tube is constructed of an ABS or polyester plastic. Also, preferably the tube is approximately 18 inches in length, approximately 1⅞ inches in internal diameter and approximately ¼ of an inch in wall thickness.

OBJECTS OF THE INVENTION

Therefore: the objects of the present invention are: to provide a launcher for aerial shell type fireworks that includes a plastic tube having sufficient strength and rigidity to withstand multiple launches from a single tube; to provide such a launcher that is constructed of a readily obtainable plastic; to provide such a launcher which significantly reduces the number of launchers required and therefore reduces shipping expense and bulk for large sets of shells; to provide such a launcher which allows sequential multiple launching of shells without significant danger due to failure of the launcher to either persons or property; to provide such a launcher which is relatively easy to construct and which can may be constructed from commonly available materials; and to provide a launcher which is inexpensive to produce, easy to manufacture and especially well adapted for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
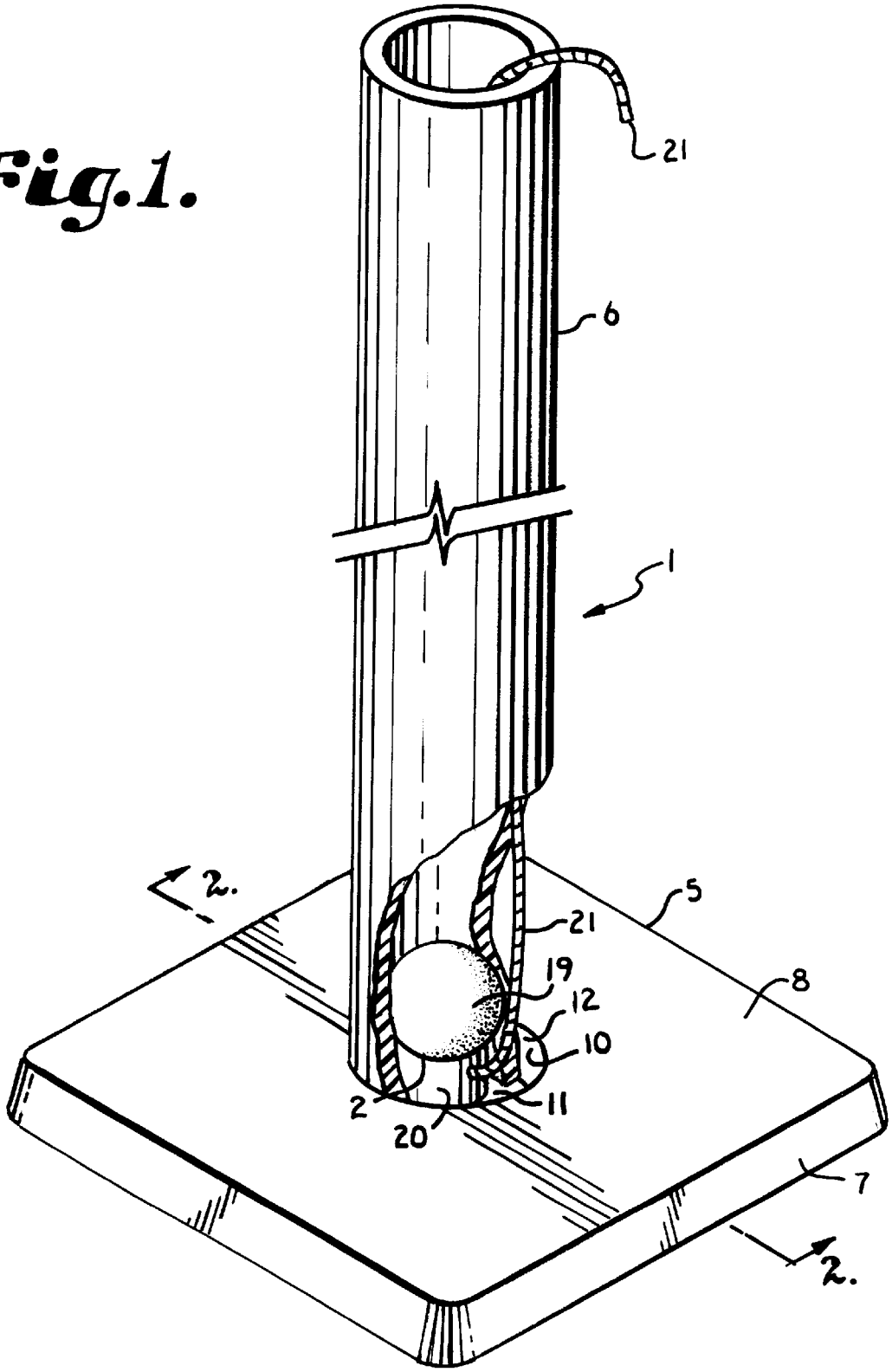
FIG. 1 is a perspective view of a fireworks shell launcher illustrating a shell in position to be launched and with portions of the launcher broken away to show greater detail thereof.
Figure 2:
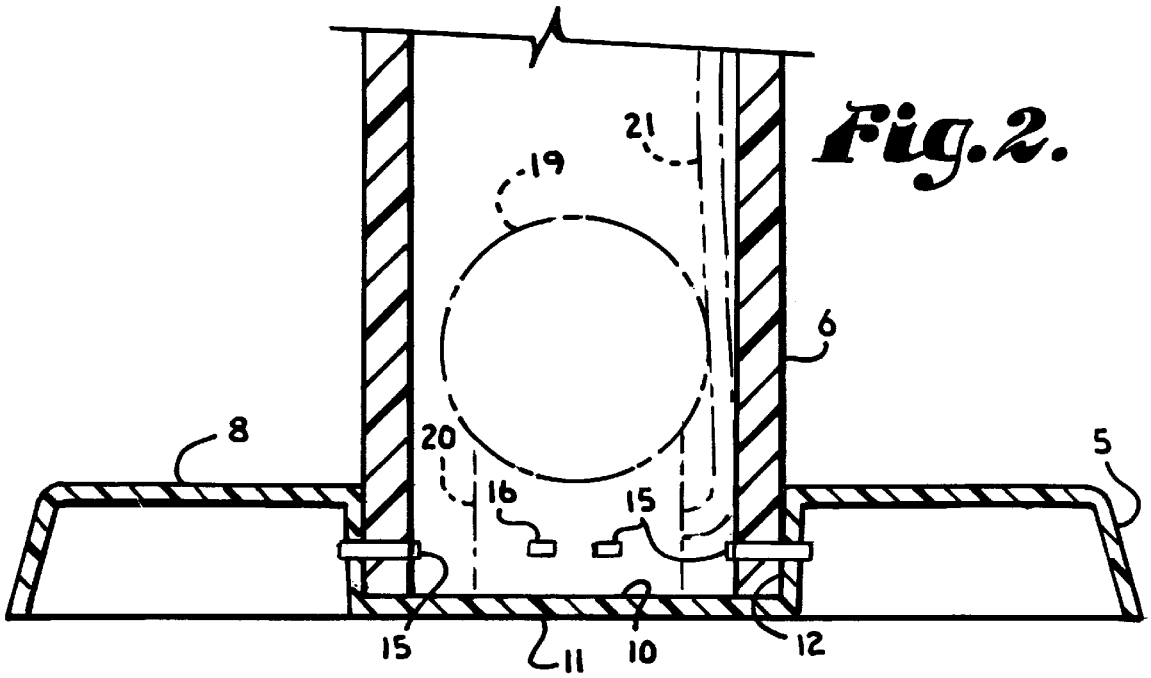
FIG. 2 is an enlarged and fragmentary cross sectional view of the launcher, taken along the line 2—2 of FIG. 1.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally designates a launcher for launching an aerial fireworks shell 2.

The launcher 1 includes a base 5 and a upright tubular member 6.

The base 5, as in the illustrated embodiment, is a generally square shaped structure having a substantially larger width and depth as compared to height. In the particular illustrated embodiment, the sides 7 of the base are slightly slanted from top to bottom so as to form a truncated four sided pyramid with a top 8 of the base. Positioned and centrally located so as to have a central axis that extends perpendicularly relative to the base top 8 is a tube receiving aperture or indentation 10 having a bottom 11 and a circular side wall 12. The indentation 10 is sized such that the inside of the side wall 12 snugly receives the outside of the tubular member 6.

The illustrated base 5 is constructed of a conventional plastic and manufactured by standard molding techniques. However, it is foreseen that the base 5 could be constructed of wood or other conventional materials that would be suitable for supporting the tubular member 6.

The tubular member 6 is secured to the base 5 by a set of staples 15 which are passed through the tubular member 6 and through the indentation side wall 12 to fixedly secure the tubular member 6 in the indentation 10. Preferably, the staples are constructed of stainless steel so as not to rust over time and thereby possibly degrade the connection between the tubular member 6 and base 5. In this manner the launcher 1 may be utilized more than one season, even if the device is left in the elements. When the staples 15 are inserted into the base 5 and tubular member 6, a metal rod having the same interior diameter as the tubular member 6 or the like is inserted into the tubular member 6 such that the staples 15 flair outwardly to form interior ears 16 which lie flat against the interior of the tubular member.

The tubular member 6 is an elongate tube having a substantially greater length than diameter. In a preferred embodiment, the tubular member 6 is approximately 18 inches long and has an inside diameter of approximately 1⅞ inch. The tube thickness can vary with the type of plastic utilized and is approximately ¼ of an inch in thickness in the illustrated embodiment using ABS plastic. The tubular member 6 can be constructed of a wide range of plastics. Preferably the material of construction is an ABS plastic or polyester plastic. Nevertheless, a number of other types of plastic such as nylon, polypropylene or the like may be utilized for the construction.

While staples have been illustrated as connecting the tubular member 6 to the base 5, it is also foreseen that the connection could be made by utilization of glues or the like. It is also foreseen that the indentation 10 for mounting the tubular member in the base 5 could be formed by cutting a single circumferential groove having essentially the same shape as the cross section of the tubular member 6.

Shown in the illustrated embodiment is a shell 2 positioned in the launcher 1. The shell includes an aerial display section 19 a launching charge 20 and a fuse 21. In use, the shell 2 is lowered into the launcher tubular member 6 and allowed to set on the bottom 11 of the base indentation 10, as is shown in FIG. 1. The fuse 21 is then lit and subsequently the fuse ignites the launching charge 20. Ignition of the launching charge 20 causes the explosion within the tubular member 6 which launches the aerial display 19 upwardly and outwardly from the tubular member 6 along the central axis of the tubular member 6. The aerial display 19 also includes a fuse which is not seen and which is lit by the fuse 21 at the same time as lighting of the fuse for the launching charge 20. Eventually the aerial display 19 explodes into a visual and/or audio display in the air, at a substantial distance above the launcher 1. Multiple shells 2 may be sequentially launched from the launcher 1 into the air. The launcher 1 may be reused for many dozens of shells 2 in a single year and/or utilized in later years, if so desired, for also launching shells 2.

It is to be understood that while certain forms of the present invention have been illustrated and described herein, it is not to be limited to the specific forms or arrangement of parts described and shown.

What is claimed and desired to be secured by Letters Patent is as follows:

1. A launcher for launching multiple aerial fireworks shells in succession from a common launchtube wherein only one of said aerial fireworks is received in the launcher at a time, said launcher comprising:

a) a unitary and continuous tubular member having a greater length than diameter and having an internal diameter that is sized and shaped to slidingly receive the aerial fireworks shells; said tubular member being generally uniform in cross-section from a bottom to a top thereof and being constructed of a plastic material;

b) a base for supporting said tubular member; said base having sufficient width and depth to support said tubular member in a stable upright manner; said base including a circular indentation thereon sized and positioned to snugly receive said tubular member and hold said tubular member in an upright configuration, when said base is positioned on a ground surface; said indentation having a floor that is positioned to engage the ground surface, when said base is placed on the ground surface; said base being constructed of a plastic material; and c) a fastener securing said tubular member to said base.

2. The launcher according to claim 1 wherein:

a) said tubular member is constructed of plastic selected from the group consisting essentially of ABS plastics and polyester plastics.

3. The launcher according to claim 1 wherein:

a) said tubular member is approximately 18 inches long and has an internal diameter of approximately 1 ⅞ inch with a wall thickness of approximately ¼ of an inch.

4. The launcher according to claim 1 wherein:

a) said base is stapled to said tubular member.

5. The launcher according to claim 1 wherein:

a) said indentation has a side wall that is circular in cross section and which is sized and shaped to snugly receive the exterior of the lower end of said tubular member.

6. The launcher according to claim 5 wherein:

a) said tubular member engages said base side wall at least one half inch along the axial length of said tubular member.

7. The launcher according to claim 6 wherein:

a) said base is stapled with staples to said tubular member.

8. The launcher according to claim 7 wherein:

a) said staples are constructed of stainless steel.

* * * * *